US010845749B2

(12) United States Patent
Sato et al.

(10) Patent No.: US 10,845,749 B2
(45) Date of Patent: Nov. 24, 2020

(54) IMAGE FORMING APPARATUS AND FOIL-PRINTED IMAGE FORMING APPARATUS

(71) Applicant: FUJI XEROX Co., Ltd., Tokyo (JP)

(72) Inventors: Kunihiko Sato, Kanagawa (JP); Yuki Nagamori, Kanagawa (JP); Keitaro Mori, Kanagawa (JP); Mitsuhiro Matsumoto, Kanagawa (JP); Aya Kakishima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/522,954

(22) Filed: Jul. 26, 2019

(65) Prior Publication Data

US 2020/0233363 A1 Jul. 23, 2020

(30) Foreign Application Priority Data

Jan. 18, 2019 (JP) ..... 2019-007346

(51) Int. Cl.
*G03G 15/00* (2006.01)
*G03G 15/20* (2006.01)

(52) U.S. Cl.
CPC ..... *G03G 15/6585* (2013.01); *G03G 15/2039* (2013.01)

(58) Field of Classification Search
CPC ..... G03G 15/6582; G03G 15/6585; G03G 2215/00426; G03G 2215/00793; G03G 2215/00797; G03G 2215/00801; G03G 2215/2006
See application file for complete search history.

(56) References Cited

U.S. PATENT DOCUMENTS 6,605,174 B1 8/2003 Landa et al.
6,977,101 B2 12/2005 Landa et al.
2013/0287455 A1* 10/2013 Suzuki ..... G03G 15/16 399/297
2014/0126924 A1* 5/2014 Nagai ..... G03G 15/205 399/69

FOREIGN PATENT DOCUMENTS

JP 2003-529460 A 10/2003
JP 2013-238733 A 11/2013

* cited by examiner

*Primary Examiner* — Thomas S Giampaolo, II
(74) *Attorney, Agent, or Firm* — Sughrue Mion, PLLC

(57) ABSTRACT

An image forming apparatus includes a first image forming unit that forms a first toner layer on a medium on which an image is to be formed, a first fixing unit that fixes the first toner layer onto the medium, a second image forming unit that forms a second toner layer on the first toner layer on the medium by using a toner having a melting point lower than a melting point of a toner that is included in the first toner layer, and a second fixing unit that performs, in a state in which a foil layer is superposed on the second toner layer, a fixing operation at a temperature lower than a temperature at which the first fixing unit performs a fixing operation.

20 Claims, 6 Drawing Sheets

IMAGE FORMING APPARATUS AND FOIL-PRINTED IMAGE FORMING APPARATUS

CROSS-REFERENCE TO RELATED APPLICATIONS

This application is based on and claims priority under 35 USC 119 from Japanese Patent Application No. 2019-007346 filed Jan. 18, 2019.

BACKGROUND

(i) Technical Field

The present disclosure relates to an image forming apparatus and a foil-printed image forming apparatus.

(ii) Related Art

The method described in Japanese Unexamined Patent Application Publication (Translation of PCT Application) No. 2003-529460 for forming a printed image having a foil-printed portion includes printing at least a portion of the image with a toner, printing a portion of the image that is to be foil printed with a foil adhesive used for affixing foil on a printing foil to the portion, the foil adhesive having a melting temperature lower than the melting temperature of the toner, pressing the printing foil against the image, and heating the printing foil to a temperature that is higher than the melting temperature of the foil adhesive and lower than the melting temperature of the toner.

SUMMARY

Aspects of non-limiting embodiments of the present disclosure relate to obtaining an image forming apparatus capable of suppressing occurrence of image irregularities in an image formed by using a toner for use in image printing, whereas in a configuration in which the toner for use in image printing, an adhesive toner that is used as an adhesive for foil, and a foil layer are fixed onto a printing medium at the same time, the occurrence of image irregularities is not suppressed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including a first image forming unit that forms a first toner layer on a medium on which an image is to be formed, a first fixing unit that fixes the first toner layer onto the medium, a second image forming unit that forms a second toner layer on the first toner layer on the medium by using a toner having a melting point lower than a melting point of a toner that is included in the first toner layer, and a second fixing unit that performs, in a state in which a foil layer is superposed on the second toner layer, a fixing operation at a temperature lower than a temperature at which the first fixing unit performs a fixing operation.

BRIEF DESCRIPTION OF THE DRAWINGS

Exemplary embodiments of the present disclosure will be described in detail based on the following figures, wherein.

DETAILED DESCRIPTION

First Exemplary Embodiment

Figure 1:
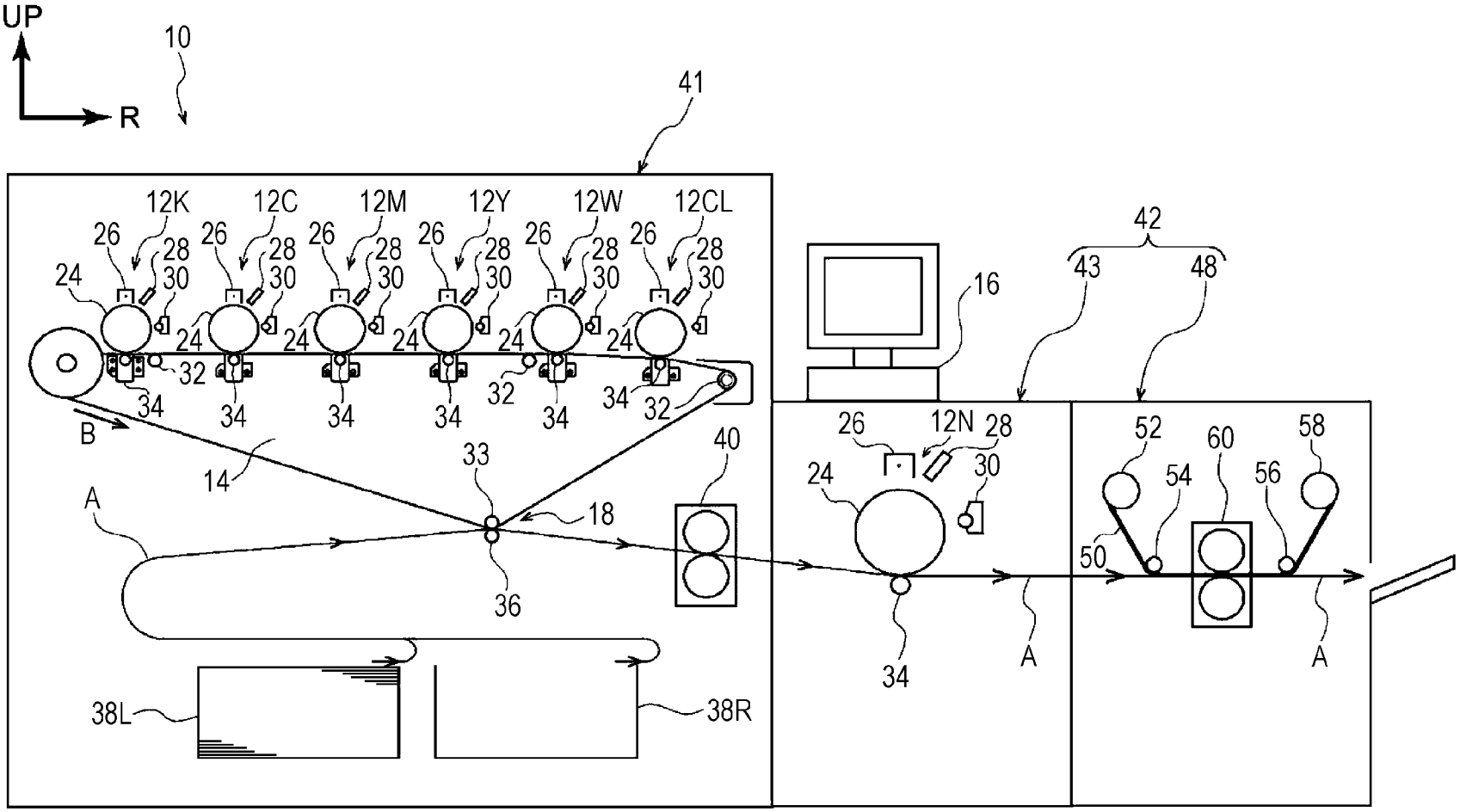
FIG. 1 is a front view illustrating an image forming apparatus according to a first exemplary embodiment.

An example of an image forming apparatus according to a first exemplary embodiment of the present disclosure (hereinafter simply referred to as "apparatus" as appropriate) and an example of a guide member according to the first exemplary embodiment will be described with reference to FIG. 1 to FIG. 3B. Note that arrow UP that is illustrated in the drawings indicates the vertical direction, which is a direction toward the upper side of the apparatus. As illustrated in FIG. 1, arrow R indicates the horizontal direction and points toward the right-hand side when the apparatus is viewed from the front. In the following description, when a top and bottom directions are mentioned without any premises, the top and bottom directions refer to the height direction of the apparatus illustrated in FIG. 1. In addition, in the following description, when a transverse direction is mentioned without any premises, the transverse direction refers to the left (L) and the right (R) directions when the apparatus illustrated in FIG. 1 is viewed from the front. Furthermore, in the following description, when a depth direction (i.e., directions toward the near side and the far side) is mentioned without any premises, the depth direction refers to a depth direction when the apparatus illustrated in FIG. 1 is viewed from the front.

[Overall Configuration of Image Forming Apparatus 10]

The configuration of an image forming apparatus 10 will be described first. FIG. 1 is a schematic front view of an image forming apparatus 10 according to the present exemplary embodiment.

As illustrated in FIG. 1, the image forming apparatus 10 includes an image forming section 41 and a foil-printed image forming apparatus 42. The image forming section 41 is positioned on an upstream side in a direction in which a transport path A for a sheet extends. The sheet corresponds to a medium, and an image is to be formed on the sheet. The foil-printed image forming apparatus 42 is positioned on a downstream side in the direction in which the transport path A extends.

The image forming apparatus 10 further includes image forming units 12 each of which employs an electrophotographic system and forms an image, an intermediate transfer belt 22 that holds a formed image, and an intermediate transfer unit 14 on which the intermediate transfer belt 22 is mounted in such a manner as to be supported by the intermediate transfer unit 14. In addition, in the image forming apparatus 10, a second transfer roller 36 that is used for transferring an image from the intermediate transfer unit 14 to the sheet, which is a medium on which an image is to be recorded, is disposed in a second transfer region 18 that is located on the lower side of the intermediate transfer unit 14.

In the second transfer region 18, toner images that are formed by the image forming units 12 are transferred onto a surface of the medium via the intermediate transfer belt 22, which is mounted on the intermediate transfer unit 14.

(Image Forming Section)

The image forming section 41 includes the plurality of image forming units 12 that form different color toner layers. In the present exemplary embodiment, the plurality of image forming units 12 includes a total of six image forming units 12, which are a clear image forming unit 12CL, a white image forming unit 12W, an image forming unit 12Y, an image forming unit 12M, an image forming unit 12C, and an image forming unit 12K that respectively correspond to clear (CL), white (W), yellow (Y), magenta (M), cyan (C), and black (K).

In the present exemplary embodiment, Y, M, C, and K are fundamental colors for outputting a color image. In contrast, CL and W serve as additional colors and each play a selective role to add a special appearance to an image. Thus, the clear image forming unit 12CL and the white image forming unit 12W may correspond to other colors (e.g., special colors such as gold and silver). Note that, in the following description, when it is not necessary to distinguish the image forming units 12 in terms of color, reference signs "CL", "W", "Y", "M", "C", and "K" that denote the corresponding colors may sometimes be omitted, and the image forming units will be simply referred to as "image forming units 12".

The image forming units 12 for the corresponding colors are configured in a similar manner except with regard to the toners that are used in the image forming units 12. As illustrated in FIG. 1, each of the image forming units 12 includes a cylindrical photoconductor 24 that rotates and a charger 26 that charges the photoconductor 24. Each of the image forming units 12 further includes an exposure device 28 that radiates exposure light onto the photoconductor 24, which has been charged, so as to form an electrostatic latent image and a developing device 30 that develops the electrostatic latent image into an image, which is formed of a toner layer, with a developer including a toner.

Each of the photoconductors 24 is configured to be capable of making contact with the intermediate transfer belt 22, which will be described later. As illustrated in FIG. 1, the image forming unit 12CL, the image forming unit 12W, the image forming unit 12Y, the image forming unit 12M, the image forming unit 12C, and the image forming unit 12K, which respectively correspond to clear, white, yellow, magenta, cyan, and black, are arranged in this order starting from an upstream side in a direction in which the intermediate transfer belt 22 moves circularly (i.e., the direction of arrow B in FIG. 1).

(Intermediate Transfer Unit 14)

The intermediate transfer unit 14 includes first transfer rollers 34 that are disposed in such a manner as to face the image forming units 12 for the corresponding colors and a backup roller 33 that is disposed in such a manner as to face the second transfer roller 36. Note that details of the second transfer roller 36 will be described later.

(Intermediate Transfer Belt 22)

As illustrated in FIG. 1, the intermediate transfer belt 22 has an endless loop shape. The intermediate transfer belt 22 is wound around and positioned by a plurality of rollers 32. In the present exemplary embodiment, when viewed from the front, the intermediate transfer belt 22 is positioned in such a manner as to form the shape of a substantially obtuse triangle that is elongated in a width direction of the apparatus and that has a corner with an obtuse angle pointing downward. One of the plurality of rollers 32 that is not illustrated in FIG. 1 has a function of causing the intermediate transfer belt 22 to rotate in the direction of arrow B by the power of a motor (not illustrated). The intermediate transfer belt 22 transports an image that has been transferred in a first transfer process to the intermediate transfer belt 22 toward the second transfer region 18 by rotating in the direction of arrow B.

The intermediate transfer belt 22 is configured to be capable of moving circularly in the direction of arrow B while being in contact with or spaced apart from the photoconductors 24 for the corresponding colors.

(First Transfer Region)

As illustrated in FIG. 1, first transfer regions are each formed of a portion where one of the photoconductors 24, the intermediate transfer belt 22, and one of the first transfer rollers 34 are in contact with one another. As illustrated in FIG. 1, the first transfer rollers 34 are disposed in such a manner as to face the photoconductors 24 with the intermediate transfer belt 22 interposed therebetween. Each of the first transfer rollers 34 and the intermediate transfer belt 22 are in contact with each other under a predetermined load. Specifically, the portions where the first transfer rollers 34 and the intermediate transfer belt 22 are in contact with each other correspond to the first transfer regions.

A voltage is applied to the first transfer rollers 34 by a power supplying unit (not illustrated). This voltage is a first transfer voltage for transferring (in the first transfer process) toner images that are formed on the photoconductors 24 onto the intermediate transfer belt 22 between the photoconductors 24 and the first transfer rollers 34.

(Second Transfer Region)

As illustrated in FIG. 1, the second transfer region 18 is formed of a portion where the intermediate transfer belt 22 and the second transfer roller 36 are in contact with each other. The intermediate transfer belt 22 is caused to be in contact with the second transfer roller 36 under a predetermined load by the backup roller 33, which is disposed in such a manner as to face the second transfer roller 36. Specifically, the portion where the intermediate transfer belt 22 and the second transfer roller 36 are in contact with each other corresponds to the second transfer region 18.

A voltage is applied to the second transfer roller 36 by a power supplying unit (not illustrated). This voltage is a second transfer voltage for transferring (in a second transfer process) toner images that have been transferred to the intermediate transfer belt 22 in such a manner as to be superposed with one another onto the sheet that is transported to the second transfer region 18.

(Fixing Device)

A fixing device 40 is disposed downstream from the second transfer region 18 in a direction in which the sheet is transported (hereinafter referred to as "sheet-transport direction"). The fixing device 40 includes a pair of rollers that face each other. The pair of rollers are arranged in such a manner as to face each other with the transport path A interposed therebetween. In other words, the sheet to which an image is to be fixed is transported so as to pass between the pair of rollers.

(Sheet Transport Path)

The transport path A, which is illustrated in FIG. 1, has a function of transporting the sheet that is prepared beforehand in a sheet tray 38R or a sheet tray 38L. Specifically, the transport path A is provided with a plurality of sheet-transport rollers (not illustrated). As a result, the sheet is transported along the transport path A so as to pass sequentially through the second transfer region 18 and the fixing device 40.

(Image Forming Operation)

An overview of an image forming operation that is performed on the sheet in the image forming section 41 will now be described.

Upon reception of an image formation command, a control device 16 causes the image forming units 12 to operate. The photoconductors 24 for the corresponding colors are charged by the corresponding chargers 26 while the photoconductors 24 are rotating. The control device 16 sends image data, which has undergone image processing performed by an image-signal processing unit (not illustrated), to each of the exposure devices 28. The exposure devices 28 expose the corresponding photoconductors 24, which have been charged, to light by radiating the exposure light onto the photoconductors 24 in accordance with the image data. As a result, electrostatic latent images are formed on the outer peripheral surfaces of the photoconductors 24. The electrostatic latent images formed on the photoconductors 24 are developed by the corresponding developing devices 30, and toner images of the different colors are formed onto the photoconductors 24 for the corresponding colors.

The different color toner images, which have been formed on the photoconductors 24 for the corresponding colors, are transferred in the first transfer process onto the intermediate transfer belt 22 by the first transfer rollers 34 for the corresponding colors in the first transfer regions. In this case, as a result of the intermediate transfer belt 22 moving circularly, the different color toner images are sequentially transferred onto the intermediate transfer belt 22 in the first transfer process while being superposed with one another. The toner images that have been superposed with one another in this manner are transported to the second transfer region 18 as a result of the intermediate transfer belt 22 moving circularly. Then, the toner images, which have been superposed with one another, are transferred onto the sheet from the intermediate transfer belt 22 in the second transfer region 18.

The sheet to which the toner images have been transferred in the second transfer process is transported toward the fixing device 40. In the fixing device 40, a surface (hereinafter suitably referred to as "front surface") of the sheet on which the toner images have been formed is heated and pressurized by a fixing belt, and the other surface (hereinafter suitably referred to as "rear surface") of the sheet that is opposite to the surface of the sheet on which the toner images have been formed is heated and pressurized by a fixing roller. As a result, the toner images formed by the image forming units 12 are fixed onto the sheet.

Note that an image that is formed of toner images formed by the image forming units 12 will be suitably referred to as "fundamental image" so as to be distinguished from an image that is formed by an adhesive-toner supply unit 43, which will be described later. In addition, the toners that are used by the image forming units 12 will be suitably referred to as "fundamental toners" so as to be distinguished from an adhesive toner that is supplied in the adhesive-toner supply unit 43, which will be described later. Here, toner images that are formed by using the fundamental toners each correspond to an example of a first toner layer.

[Configuration of Principal Portion]

The configuration of a principal portion in the present exemplary embodiment will now be described.

(Foil-Printed Image Forming Apparatus 42)

As illustrated in FIG. 1, the foil-printed image forming apparatus 42 is disposed downstream from the image forming section 41 in the sheet-transport direction. The foil-printed image forming apparatus 42 includes the adhesive-toner supply unit 43 and a foil fixing unit 48.

(Adhesive-Toner Supply Unit 43)

The adhesive-toner supply unit 43 includes an image forming unit 12N that is used for supplying the adhesive toner and a first transfer roller 34. Regarding the configuration of the image forming unit 12N and an image forming operation that is performed by the image forming unit 12N, the image forming unit 12N employs an electrophotographic system like the image forming units 12 in the image forming section 41, and thus, components similar to the components included in the image forming units 12 are denoted by the same reference signs, and descriptions of the components and their operations will be omitted.

A toner layer that is formed by the image forming unit 12N using the adhesive toner is directly transferred onto the sheet in a first transfer process by a voltage that is applied to the first transfer rollers 34. Here, this adhesive toner layer corresponds to an example of a second toner layer.

The adhesive toner layer formed by the image forming unit 12N is formed by using a toner having a melting point lower than each of the melting points of the toners that are used for forming the fundamental image in the image forming section 41. In addition, although this toner with a low melting point often does not include pigment and wax (i.e., oil) that are included in a normal toner, the toner may include the pigment and wax.

(Foil Fixing Unit 48)

The foil fixing unit 48 includes a feed roller 52, an upstream roller 54, a downstream roller 56, a collecting roller 58, and a second fixing device 60. The feed roller 52 and the upstream roller 54 are arranged upstream from the second fixing device 60 in the sheet-transport direction. The downstream roller 56 and the collecting roller 58 are arranged downstream from the second fixing device 60 in the sheet-transport direction.

The feed roller 52 and the upstream roller 54 form a feeding unit that feeds a foil sheet 50 and that corresponds to an example of a feeding unit.

The downstream roller 56 and the collecting roller 58 form a removing unit that removes the foil sheet 50 and that corresponds to an example of a removing unit.

The foil sheet 50 is wound around the feed roller 52. The foil sheet 50 is extended from the feed roller 52 and fed to the upstream roller 54, the downstream roller 56, and the collecting roller 58 in this order. In addition, the foil sheet 50 fed to the collecting roller 58 is collected as a result of being wound around the collecting roller 58.

The foil sheet 50 is disposed along the transport path A between the upstream roller 54 and the downstream roller 56. Specifically, the foil sheet 50 is disposed between the upstream roller 54 and the downstream roller 56 in such a manner that a foil member 66 (details will be described later) is superposed on the surface of the sheet on which an image has been formed, the sheet being transported along the transport path A. In addition, the foil sheet 50 is disposed in such a manner as to pass through, together with the transport path A, a fixing nip of the second fixing device 60 between the upstream roller 54 and the downstream roller 56. Specifically, the foil sheet 50 and the transport path A are arranged in such a manner as to pass between a pair of rollers that are included in the second fixing device 60.

(Second Fixing Device 60)

As illustrated in FIG. 1, the second fixing device 60 includes the pair of upper and lower rollers that are arranged in such a manner as to face each other with the transport path A and the foil sheet 50 interposed therebetween. The upper roller and the lower roller are pressed against each other under a constant load.

The upper roller is equipped with a built-in halogen lamp, which is not illustrated. As a result, the upper roller is heated such that the temperature of a surface thereof reaches a desired fixing temperature.

The lower roller is heated by the upper roller via the foil sheet 50 or via the foil sheet 50 and the sheet.

(Foil Sheet 50)

Figure 2:
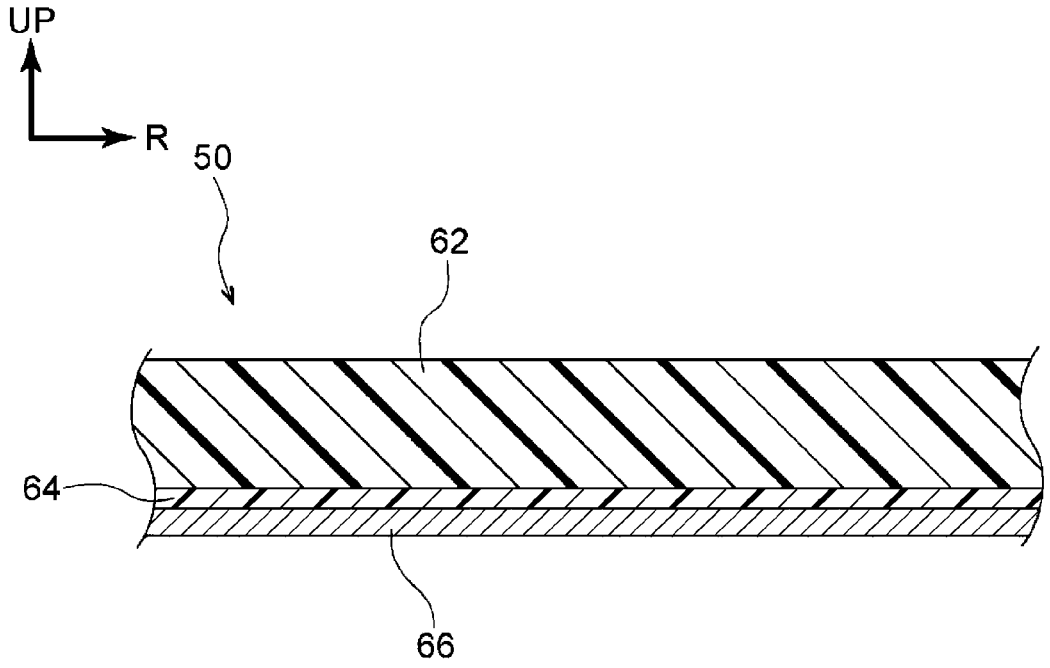
FIG. 2 is a front view illustrating a foil sheet that is used in the image forming apparatus according to the first exemplary embodiment.

As illustrated in FIG. 2, the foil sheet 50 includes a base member 62, an adhesive layer 64, and the foil member 66 that are stacked on top of one another. A layer that is formed of this foil member 66 will hereinafter be referred to as "foil layer" as appropriate. Specifically, the foil member 66 is held in a state of being stacked on a surface of the base member 62 with the adhesive layer 64 interposed therebetween by the adhesive force of the adhesive layer 64.

The base member 62 is made of a resin including polyethylene terephthalate (PET) and is in the form of a sheet. The adhesive layer 64 is formed by applying a resin material that is softened and whose adhesive force decreases as a result of being heated to the base member 62 such that the resin material forms a layer. As an example, the foil member 66 is formed of a layer of foil including aluminum.

(Foil-Printed Image Forming Operation)

A foil-printed image forming operation that is performed in the foil-printed image forming apparatus 42 will now be described.

(Adhesive-Toner Supply Unit 43)

In the adhesive-toner supply unit 43, the adhesive toner is supplied to the sheet by the image forming unit 12N that employs an electrophotographic system.

(Foil Fixing Unit 48)

In the foil fixing unit 48, the foil member 66 is transferred onto a portion of the sheet to which the adhesive toner has been supplied by the adhesive-toner supply unit 43. The portion to which the foil member 66 has been transferred in this manner becomes a foil-printed image.

The foil sheet 50 is superposed on the sheet, which has been transported along the transport path A, by the feeding unit, and after the sheet has passed through the second fixing device 60, the foil sheet 50 is removed by the removing unit.

The sheet, on which the foil sheet 50 has been superposed, is heated and pressurized by the fixing roller when the sheet passes through the second fixing device 60. In this case, the foil member 66 of the foil sheet 50 adheres to a portion of the sheet where the adhesive toner has been provided between the foil sheet 50 and the sheet. In addition, the foil member 66 is not press-bonded to a portion of the sheet where the adhesive toner is not provided between the foil sheet 50 and the sheet, and the foil member 66 is removed with the foil sheet 50 from the sheet by the removing unit. In this manner, a foil-printed image is formed by causing the sheet to have a portion to which the foil member 66 is transferred and a portion to which the foil member 66 is not transferred.

Figure 3A:
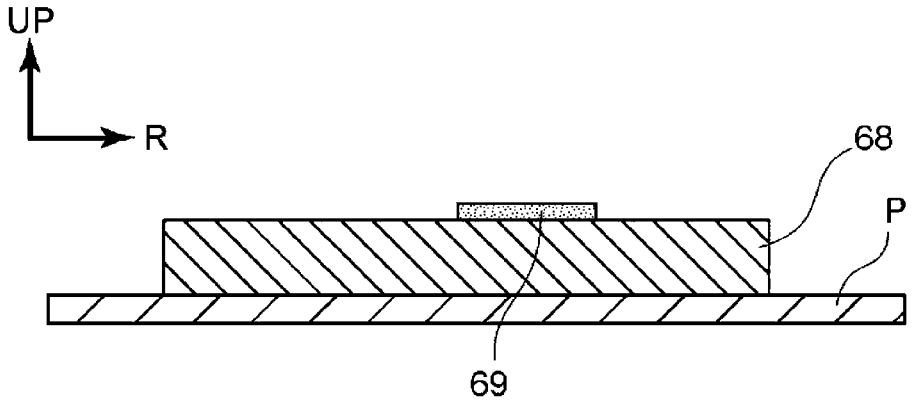
FIGS. 3A and 3B are front views each illustrating a foil-printed image that is formed by the image forming apparatus according to the first exemplary embodiment.

FIG. 3A illustrates the state of a sheet P that has passed through the image forming section 41 and the adhesive-toner supply unit 43. An image formed in the image forming section 41 is placed on the sheet P. Note that, in FIG. 3A, the toner layers of the different colors that are formed by the image forming units 12 for the corresponding colors in the image forming section 41 and that form a fundamental image 68 are collectively illustrated as a single toner layer for simplification.

An adhesive toner layer 69 that is formed by the image forming unit 12N in the adhesive-toner supply unit 43 is placed on the upper layer of the fundamental image 68. Here, as mentioned above, the adhesive toner layer 69 is formed on a portion of the sheet P on which a foil-printed image is to be formed.

Figure 3B:
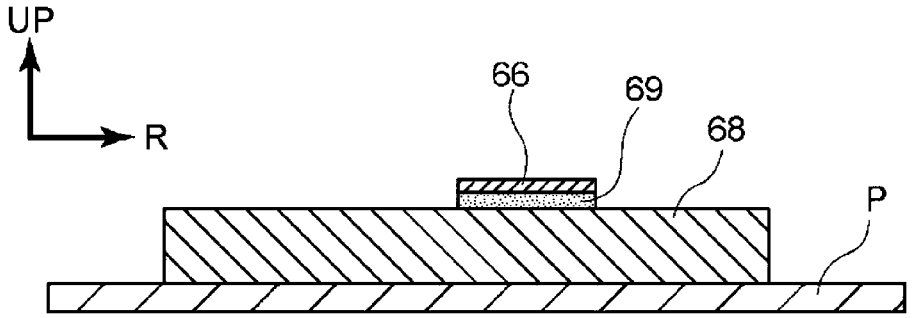

FIG. 3B illustrates the state of the sheet P that has passed through the foil fixing unit 48. The foil fixing unit 48 forms the foil layer 66 onto the top surface of the adhesive toner layer 69, which has been formed by the image forming unit 12N. In other words, the fundamental image 68 and the adhesive toner layer 69 are sandwiched between the sheet P and the foil layer 66 at a position on the sheet P where the foil layer 66 is formed by the foil fixing unit 48. In addition, the adhesive toner layer 69 is sandwiched between the fundamental image 68 and the foil layer 66.

(Second Fixing Device 60)

A fixing temperature in the second fixing device 60 is lower than a fixing temperature in the fixing device 40.

Here, the fixing temperature in the fixing device 40 is set to a temperature that is higher than each of the melting points of the fundamental toners. In contrast, the fixing temperature in the second fixing device 60 is set to a temperature that is lower than each of the melting points of the fundamental toners. In addition, the fixing temperature of the second fixing device 60 is set to a temperature that is higher than the melting point of the adhesive toner.

(Image Forming Operation for Image Having Portion with Density of 100% or More)

In the case where the fundamental image has a portion with a density of 100% or more, a fixing speed of the fixing device 40 is slower than that in the case where the fundamental image does not have a portion with a density of 100% or more. In addition, in this case, the fixing temperature of the second fixing device 60 is lower than that in the case where the fundamental image does not have a portion with a density of 100% or more.

Here, regarding the conditions under which the fixing speed and the fixing temperature of the fixing device 40 are changed, the fixing speed and the fixing temperature of the fixing device 40 may be changed when the fundamental image has a portion with a density of 100% or more, and the adhesive toner layer is formed thereonto, or when the fundamental image has a portion with a density of 100% or more, and a foil-printed image is formed thereonto.

Note that the wording "a density of 100% or more" refers to the state in which a toner layer forming a toner image covers the front surface of a portion of the sheet, the portion being a region of the sheet in which an image is to be formed. In contrast, when an image with a low density is formed, a toner is provided on the sheet in a dotted manner or in the form of a mesh. Such a state in which the toner does not completely cover the front surface of the sheet will be expressed as "a density of less than 100%".

In the case where the fundamental image has a portion with a density of 100% or more, a fixing speed of the second fixing device 60 may be set to be slower than the fixing speed of the fixing device 40. In addition, in this case, the fixing temperature of the second fixing device 60 may be set to a temperature lower than that in the case where the fundamental image does not have a portion with an image density of 100% or more.

Note that the term "fixing speed" corresponds to the transport speed of the sheet that passes through the fixing device 40 or 60 (i.e., the speed at which the pair of rollers of the fixing device rotate). More specifically, the rotational speed of the surfaces of the pair of rollers, which transport the sheet while fixing an image onto the sheet, corresponds to the fixing speed.

Here, it is determined whether the fundamental image has a portion with a density of 100% or more on the basis of image data that is output by the control device 16. The control device 16 also controls the fixing speed and the fixing temperature of each of the fixing devices 40 and 60.

<Operations and Effects>

Operations and effects of the present exemplary embodiment will now be described.

In the image forming section 41, toner images that are formed by the image forming units 12 are transferred onto the sheet. Then, in the adhesive-toner supply unit 43, the adhesive toner is supplied to a desired portion of the sheet. In addition, in the foil fixing unit 48, a foil-printed image is formed on the portion of the sheet to which the adhesive toner has been supplied.

In other words, the foil fixing unit 48 is configured not to form a foil-printed image onto a portion of the sheet to which the adhesive toner is not supplied by the adhesive-toner supply unit 43.

In the present exemplary embodiment, the toner images formed by the image forming units 12 are fixed onto the sheet by the fixing device 40 before the adhesive toner is supplied to the sheet. Accordingly, the second fixing device 60 in the foil fixing unit 48 does not need to fix the toner images, which have been formed on the sheet by the image forming units 12, onto the sheet. In other words, the second fixing device 60 fixes only the adhesive toner, which has been supplied to the sheet, and the foil member 66 onto the sheet.

Thus, the second fixing device 60 does not need to fix the toner images formed on the sheet by the image forming units 12 onto the sheet and may be configured to supply the amount of heat and the amount of pressure that are required for fixing the adhesive toner and the foil member 66 onto the sheet.

Here, the melting point of the adhesive toner and the melting point of the adhesive toner included in the foil sheet 50 are each lower than each of the melting points of the fundamental toners, which are used by the image forming units 12. Thus, the fixing temperature of the second fixing device 60 may be set to be lower than the fixing temperature of the fixing device 40, whereas in the case where an image forming apparatus does not include the fixing device 40, the fixing temperature of the second fixing device 60 would not be set to be lower than the fixing temperature of the fixing device 40.

In addition, the fixing temperature of the second fixing device 60 is set to be lower than each of the melting points of the toners used by the image forming units 12.

In the present exemplary embodiment, in the case where the fundamental image has a portion with a density of 100% or more, the fixing speed of the second fixing device 60 is set to be slower than that in the case where the fundamental image does not have a portion with a density of 100% or more.

In addition, in the case where the fundamental image has a portion with a density of 100% or more, the second fixing device 60 performs a fixing operation at a temperature lower than that in the case where the fundamental image does not have a portion with a density of 100% or more.

Here, more specifically, in the case where the fundamental image has a portion with a density of 100% or more, the fixing temperature of the second fixing device 60 may be set to a temperature that is lower than that in the case where the fundamental image does not have a portion with a density of 100% or more and that is higher than the melting point of the adhesive toner.

In contrast, also in the case where the fundamental image has a portion with a density of 100% or more, the fixing temperature of the second fixing device 60 is set to a temperature higher than the melting point of the adhesive toner.

Second Exemplary Embodiment

An image forming apparatus according to a second exemplary embodiment of the present disclosure will be described with reference to FIG. 4. Note that the image forming apparatus according to the second exemplary embodiment is a modification of the image forming apparatus according to the first exemplary embodiment. Thus, the same components will be suitably denoted by the same reference signs, and repeated descriptions will be suitably omitted.

Note that the configuration of the image forming apparatus according to the second exemplary embodiment is similar to that of the image forming apparatus in the first exemplary embodiment excluding a portion that corresponds to the adhesive-toner supply unit 43 of the first exemplary embodiment, and thus, description thereof will be omitted.

Figure 4:
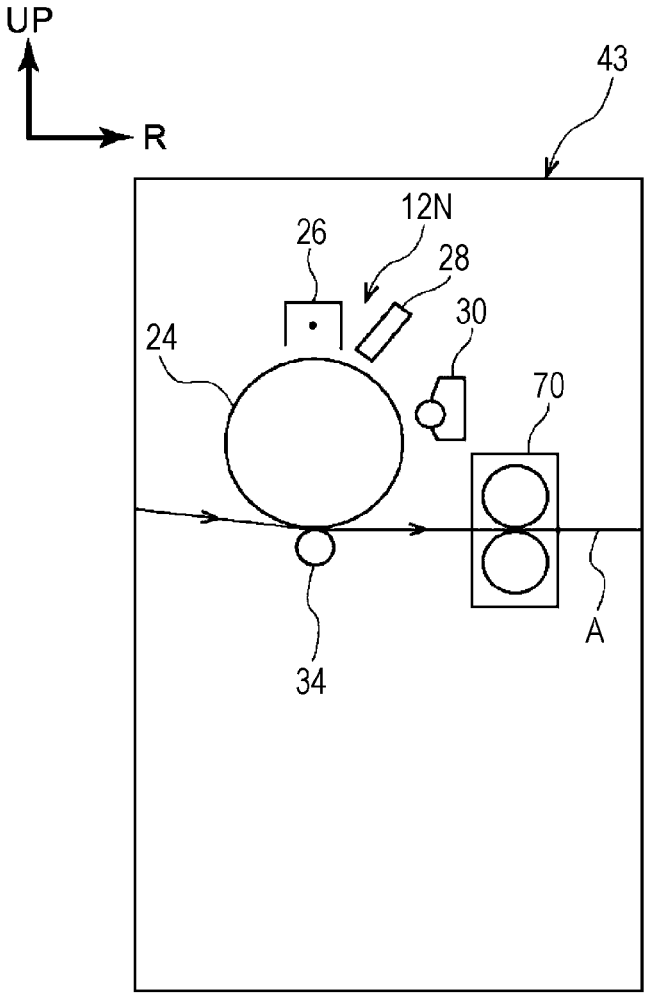
FIG. 4 is a front view illustrating an adhesive-toner supply unit according to a second exemplary embodiment.

As illustrated in FIG. 4, in the present exemplary embodiment, the adhesive-toner supply unit 43 includes a third fixing device 70. The third fixing device 70 is disposed downstream from the image forming unit 12N, which is used for supplying the adhesive toner, in the sheet-transport direction.

The third fixing device 70 includes a pair of upper and lower rollers that are arranged in such a manner as to face each other with the transport path A interposed therebetween. The upper roller (a heating roller) and the lower roller (a pressure roller) are pressed against each other under a constant load.

With such a configuration, the adhesive toner that is supplied to the sheet by the image forming unit 12N is fixed onto the sheet by the third fixing device 70 before the sheet is transported toward the foil fixing unit 48. Note that a fixing temperature of the third fixing device 70 is set to be lower than the fixing temperature of the fixing device 40.

Here, the fixing temperature of the third fixing device 70 may be set to be lower than each of the melting points of the toners included in the fundamental image.

<Operations and Effects>

Operations and effects of the image forming apparatus according to the second exemplary embodiment will now be described.

According to the third fixing device 70, the adhesive toner and the upper fixing roller directly come into contact with each other without the foil sheet 50 interposed therebetween, so that the adhesive toner is more efficiently heated than in the second fixing device 60. Thus, the fixing temperature of the second fixing device 60 may be further lowered.

Note that the fixing temperature of the third fixing device 70 may be set to a temperature that is higher than the melting point of the adhesive toner.

Third Exemplary Embodiment

An image forming apparatus according to a third exemplary embodiment of the present disclosure will be described with reference to FIG. 5. Note that the image forming apparatus according to the third exemplary embodiment is another modification of the image forming apparatuses according to the first and second exemplary embodiments. Thus, the same components will be suitably denoted by the same reference signs, and repeated descriptions will be suitably omitted.

Note that the configuration of the image forming apparatus according to the third exemplary embodiment is similar to that of the image forming apparatus in the first exemplary embodiment excluding a portion that corresponds to the adhesive-toner supply unit 43 of the first exemplary embodiment.

In addition, in the adhesive-toner supply unit 43 according to the third exemplary embodiment, the configurations of the image forming unit 12N and the third fixing device 70 are similar to those in the second exemplary embodiment.

Figure 5:
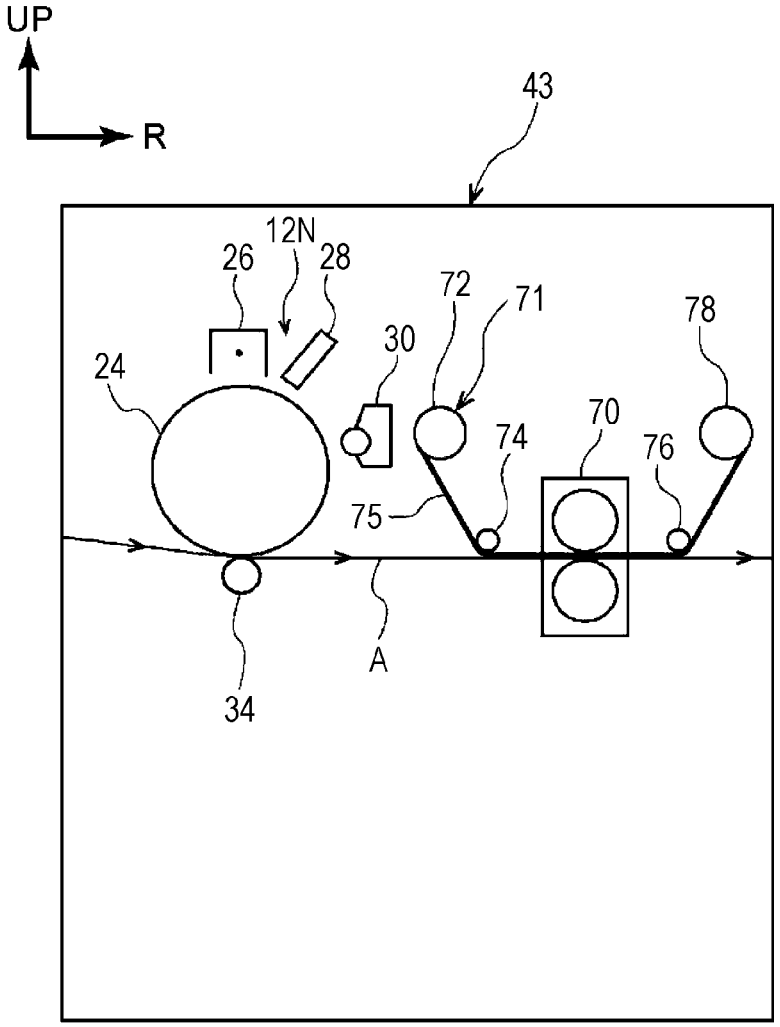
FIG. 5 is a front view illustrating an adhesive-toner supply unit according to a third exemplary embodiment.

As illustrated in FIG. 5, in the present exemplary embodiment, the adhesive-toner supply unit 43 includes the third fixing device 70 and a release-sheet feeding device 71. The third fixing device 70 and the release-sheet feeding device 71 are disposed downstream from the image forming unit 12N in the sheet-transport direction.

The release-sheet feeding device 71 includes a feed roller 72, an upstream roller 74, a downstream roller 76, and a collecting roller 78. The feed roller 72 and the upstream roller 74 are arranged upstream from the third fixing device 70 in the sheet-transport direction. The downstream roller 76 and the collecting roller 78 are arranged downstream from the third fixing device 70 in the sheet-transport direction.

The supply roller 72 and the upstream roller 74 correspond to a feeding unit that feeds a release sheet 75. The downstream roller 76 and the collecting roller 78 correspond to a removing unit that removes the release sheet 75.

The release sheet 75 is wound around the feed roller 72. The release sheet 75 includes perfluoroalkoxy fluorocarbon resin (PFA). In addition, the release sheet 75 has a smooth surface. Thus, melted toner and the like are less likely to be deposited onto the feed roller 72.

The release sheet 75 is extended from the feed roller 72 and fed to the upstream roller 74, the downstream roller 76, and the collecting roller 78 in this order. In addition, the release sheet 75 fed to the collecting roller 78 is collected as a result of being wound around the collecting roller 78.

The release sheet 75 is disposed along the transport path A between the upstream roller 74 and the downstream roller 76. Specifically, the release sheet 75 is disposed between the upstream roller 74 and the downstream roller 76 in such a manner as to be superposed on the surface of the sheet on which an image has been formed, the sheet being transported along the transport path A. In addition, the release sheet 75 is disposed in such a manner as to pass through, together with the transport path A, the third fixing device 70 between the upstream roller 74 and the downstream roller 76. Specifically, the release sheet 75 and the transport path A are arranged in such a manner as to pass between the pair of rollers that are included in the third fixing device 70.

(Adhesive-Toner Supply Operation)

According to the present exemplary embodiment, in the adhesive-toner supply unit 43, the release sheet 75 is superposed on the front side of the sheet to which the adhesive toner has been supplied (i.e., the surface of the sheet to which the adhesive toner has been supplied) before the sheet passes through the third fixing device 70. The sheet on which the release sheet 75 has been superposed is transported toward the third fixing device 70, and the third fixing device 70 fixes the adhesive toner onto the sheet in a state where the release sheet 75 has been superposed on the sheet. Subsequently, the sheet passes through the fixing device 70, and then the release sheet 75 is removed from the sheet by the downstream roller 76.

<Operations and Effects>

Operations and effects of the image forming apparatus according to the third exemplary embodiment will now be described.

According to the third exemplary embodiment, when the adhesive toner is fixed onto the sheet by the third fixing device 70, the adhesive toner comes into contact with the upper roller with the release sheet 75 interposed therebetween.

<Other Exemplary Embodiments>

Although the image forming apparatuses according to the exemplary embodiments have been described above, it is obvious that the present disclosure may be implemented in various aspects within the gist of the present disclosure.

Figure 6:
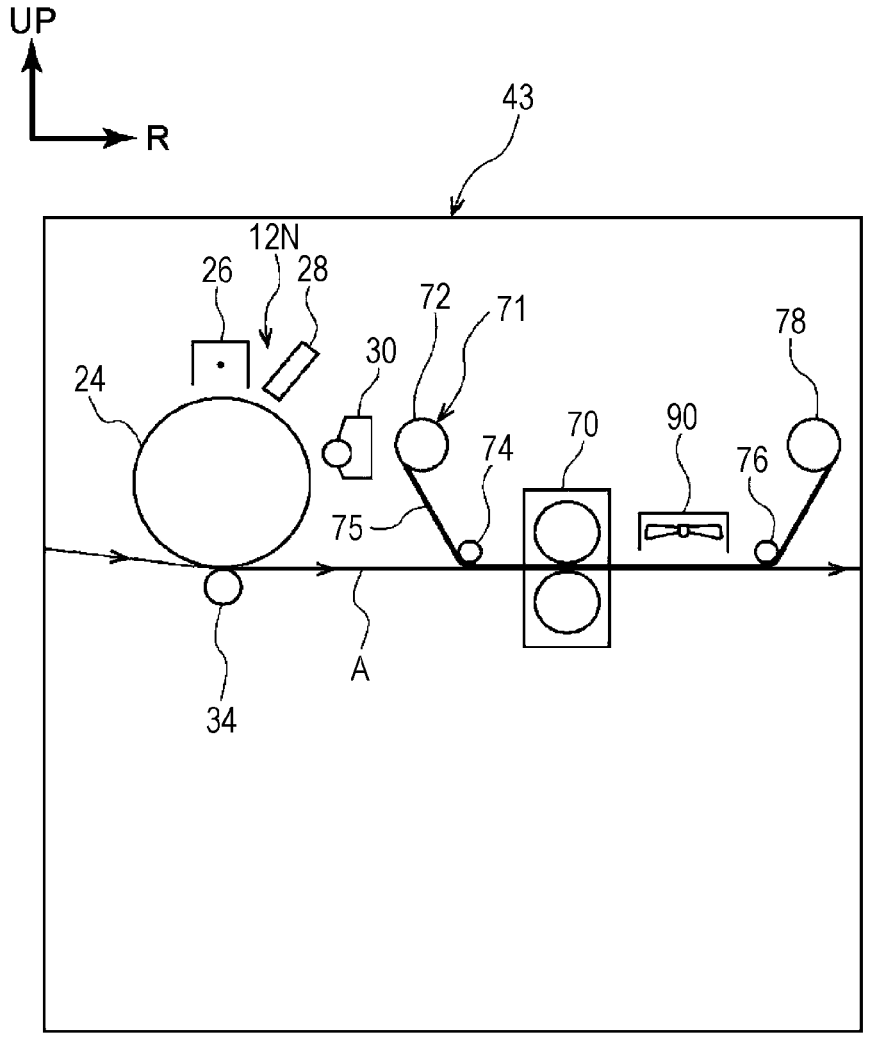
FIG. 6 is a front view illustrating an adhesive-toner supply unit according to another exemplary embodiment.

For example, as illustrated in FIG. 6, in the third exemplary embodiment, a cooling device 90 may be provided between the third fixing device 70 and the downstream roller 76. Here, the cooling device 90 rapidly cools the adhesive toner on the sheet via the release sheet 75. The cooling device 90 causes the adhesive toner to solidify in a state of being deposited on the fundamental image. After that, the release sheet 75 is removed from the sheet by the downstream roller 76.

Note that, in the third exemplary embodiment, the release sheet 75 may be formed to have an endless loop shape and may have a structure whereby the release sheet 75 is delivered from the collecting roller 78 to the feed roller 72.

In addition, in each of the exemplary embodiments, the image forming section 41, the adhesive-toner supply unit 43, and the foil fixing unit 48 are integrated with one another so as to form the image forming apparatus 10. However, the image forming section 41, the adhesive-toner supply unit 43, and the foil fixing unit 48 may be provided separately from one another.

For example, only the foil-printed image forming apparatus 42 including the adhesive-toner supply unit 43 and the foil fixing unit 48 that are integrated with each other may be provided independently of the image forming section 41. With such a configuration, a foil-printed image may be formed on a fundamental image that is formed by a general-purpose image forming apparatus that employs an electrophotographic system.

Note that, in such a configuration, the control device 16, which is included in the foil-printed image forming apparatus 42, acquires information items regarding the fixing temperatures and the fixing speeds of the image forming apparatuses that form the fundamental image, the melting points of the toners, an image-formation position, whether the fundamental image has a portion with a density of 100%, and so forth.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a first image forming unit that forms a first toner layer on a medium on which an image is to be formed;

a first fixing unit that fixes the first toner layer onto the medium;

a second image forming unit that forms a second toner layer on the first toner layer on the medium by using a toner having a melting point lower than a melting point of a toner that is included in the first toner layer; and a second fixing unit that performs, in a state in which a foil layer is superposed on the second toner layer, a fixing operation at a temperature lower than a temperature at which the first fixing unit performs a fixing operation, wherein the second toner layer is not fixed on the recording medium before being fixed by the second fixing unit.

2. The image forming apparatus according to claim 1, wherein, when an image that is formed of the first toner layer, which is positioned below the second toner layer, has a density of 100% or more, the second fixing unit performs the fixing operation at a speed lower than a fixing speed that is set when the image that is formed of the first toner layer has a density of less than 100%.

3. The image forming apparatus according to claim 2, wherein, when an image that is formed of the first toner layer, which is positioned below the second toner layer, has a density of 100% or more, the second fixing unit performs the fixing operation at a temperature lower than a fixing temperature that is set when the image that is formed of the first toner layer has a density of less than 100%.

4. The image forming apparatus according to claim 3, further comprising:

a third fixing unit that is disposed at a position on a transport path for the medium, the position being downstream from a position at which the second toner layer is formed on the first toner layer and upstream from a position at which the foil layer is superposed on the second toner layer, and that fixes the second toner layer onto the medium.

5. The image forming apparatus according to claim 4, wherein the third fixing unit performs a fixing operation at a temperature equal to or lower than a fixing temperature of the first fixing unit.

6. The image forming apparatus according to claim 5, wherein the third fixing unit fixes the second toner layer onto the medium via a sheet that covers a surface of the medium on which the second toner layer is formed, and wherein the image forming apparatus further includes a feeding unit that feeds the sheet at a position downstream from the position at which the second toner layer is formed on the first toner layer and upstream from a position at which the third fixing unit performs the fixing operation in a direction in which the medium is transported and a removing unit that removes the sheet at a position downstream from the position at which the third fixing unit performs the fixing operation and upstream from the position at which the foil layer is superposed on the second toner layer.

7. The image forming apparatus according to claim 4, wherein the third fixing unit fixes the second toner layer onto the medium via a sheet that covers a surface of the medium on which the second toner layer is formed, and wherein the image forming apparatus further includes a feeding unit that feeds the sheet at a position downstream from the position at which the second toner layer is formed on the first toner layer and upstream from a position at which the third fixing unit performs the fixing operation in a direction in which the medium is transported and a removing unit that removes the sheet at a position downstream from the position at which the third fixing unit performs the fixing operation and upstream from the position at which the foil layer is superposed on the second toner layer.

8. The image forming apparatus according to claim 2, further comprising:

a third fixing unit that is disposed at a position on a transport path for the medium, the position being downstream from a position at which the second toner layer is formed on the first toner layer and upstream from a position at which the foil layer is superposed on the second toner layer, and that fixes the second toner layer onto the medium.

9. The image forming apparatus according to claim 8, wherein the third fixing unit performs a fixing operation at a temperature equal to or lower than a fixing temperature of the first fixing unit.

10. The image forming apparatus according to claim 9, wherein the third fixing unit fixes the second toner layer onto the medium via a sheet that covers a surface of the medium on which the second toner layer is formed, and wherein the image forming apparatus further includes a feeding unit that feeds the sheet at a position downstream from the position at which the second toner layer is formed on the first toner layer and upstream from a position at which the third fixing unit performs the fixing operation in a direction in which the medium is transported and a removing unit that removes the sheet at a position downstream from the position at which the third fixing unit performs the fixing operation and upstream from the position at which the foil layer is superposed on the second toner layer.

11. The image forming apparatus according to claim 8, wherein the third fixing unit fixes the second toner layer onto the medium via a sheet that covers a surface of the medium on which the second toner layer is formed, and wherein the image forming apparatus further includes a feeding unit that feeds the sheet at a position downstream from the position at which the second toner layer is formed on the first toner layer and upstream from a position at which the third fixing unit performs the fixing operation in a direction in which the medium is transported and a removing unit that removes the sheet at a position downstream from the position at which the third fixing unit performs the fixing operation and upstream from the position at which the foil layer is superposed on the second toner layer.

12. The image forming apparatus according to claim 1, further comprising:

a third fixing unit that is disposed at a position on a transport path for the medium, the position being downstream from a position at which the second toner layer is formed on the first toner layer and upstream from a position at which the foil layer is superposed on the second toner layer, and that fixes the second toner layer onto the medium.

13. The image forming apparatus according to claim 12, wherein the third fixing unit performs a fixing operation at a temperature equal to or lower than a fixing temperature of the first fixing unit.

14. The image forming apparatus according to claim 13, wherein the third fixing unit fixes the second toner layer onto the medium via a sheet that covers a surface of the medium on which the second toner layer is formed, and wherein the image forming apparatus further includes a feeding unit that feeds the sheet at a position downstream from the position at which the second toner layer is formed on the first toner layer and upstream from a position at which the third fixing unit performs the fixing operation in a direction in which the medium is transported and a removing unit that removes the sheet at a position downstream from the position at which the third fixing unit performs the fixing operation and upstream from the position at which the foil layer is superposed on the second toner layer.

15. The image forming apparatus according to claim 12, wherein the third fixing unit fixes the second toner layer onto the medium via a sheet that covers a surface of the medium on which the second toner layer is formed, and wherein the image forming apparatus further includes a feeding unit that feeds the sheet at a position downstream from the position at which the second toner layer is formed on the first toner layer and upstream from a position at which the third fixing unit performs the fixing operation in a direction in which the medium is transported and a removing unit that removes the sheet at a position downstream from the position at which the third fixing unit performs the fixing operation and upstream from the position at which the foil layer is superposed on the second toner layer.

16. A foil-printing image forming apparatus comprising:

a second image forming unit that forms a second toner layer on a medium on which an image is to be formed and to which a first toner layer has been fixed by using a toner having a melting point lower than a melting point of a toner that is included in the first toner layer; and a second fixing unit that superposes a foil layer on the second toner layer and that performs a fixing operation at a temperature lower than the melting point of the toner that is included in the first toner layer, wherein the second toner layer is not fixed on the recording medium before being fixed by the second fixing unit.

17. The foil-printing image forming apparatus according to claim 16, further comprising:

a third fixing unit that is disposed at a position on a transport path for the medium, the position being downstream from a position at which the second toner layer is formed on the medium and upstream from a position at which the foil layer is superposed on the second toner layer, and that fixes the second toner layer onto the medium.

18. The foil-printing image forming apparatus according to claim 17, wherein the third fixing unit performs a fixing operation at a temperature equal to or lower than the melting point of the toner that is included in the first toner layer.

19. The foil-printing image forming apparatus according to claim 18, wherein the third fixing unit comes into contact with the medium with a sheet, which covers a surface of the medium on which the second toner layer is formed, interposed between the third fixing unit and the medium, and wherein the foil-printing image forming apparatus further includes a feeding unit that feeds the sheet at a position downstream from the position at which the second toner layer is formed on the medium and upstream from a position at which the third fixing unit performs the fixing operation in a direction in which the medium is transported and a removing unit that removes the sheet at a position downstream from the position at which the third fixing unit performs the fixing operation and upstream from the position at which the foil layer is superposed on the second toner layer.

20. The foil-printing image forming apparatus according to claim 17, wherein the third fixing unit comes into contact with the medium with a sheet, which covers a surface of the medium on which the second toner layer is formed, interposed between the third fixing unit and the medium, and wherein the foil-printing image forming apparatus further includes a feeding unit that feeds the sheet at a position downstream from the position at which the second toner layer is formed on the medium and upstream from a position at which the third fixing unit performs the fixing operation in a direction in which the medium is transported and a removing unit that removes the sheet at a position downstream from the position at which the third fixing unit performs the fixing operation and upstream from the position at which the foil layer is superposed on the second toner layer.

* * * * *